US005271387A

United States Patent [19]

Murray

[11] Patent Number: 5,271,387

[45] Date of Patent: Dec. 21, 1993

[54] HARNESS CONNECTOR FOR SCUBA TANKS AND THE LIKE

[75] Inventor: Christopher A. Murray, Brooklyn, N.Y.

[73] Assignee: Murray Dive Inc., Brooklyn, N.Y.

[21] Appl. No.: 931,573

[22] Filed: Aug. 11, 1992

[51] Int. Cl.[5] ..... B63C 11/02

[52] U.S. Cl. ..... 128/200.24; 128/205.22; 405/186; 248/222.2; 224/271

[58] Field of Search ..... 224/211, 270, 269, 271; 215/100 R, 101; 114/315; 405/186; 24/457, 458, 591, 598.4; 248/222.2; 128/200.24, 205.22

[56] References Cited

U.S. PATENT DOCUMENTS

| | | | |
|---|---|---|---|
| 99,508 | 2/1870 | Williams | 24/573.1 |
| 612,048 | 10/1898 | Miller | 248/222.2 X |
| 821,498 | 5/1906 | Jackson | 248/222.2 X |
| 2,406,888 | 9/1946 | Meidenbauer | 128/205.22 X |
| 3,033,431 | 5/1962 | Henderson et al. | 224/211 |
| 3,065,888 | 11/1962 | Lande | 224/211 |
| 3,191,828 | 6/1965 | Senne | 224/211 |
| 3,310,270 | 3/1967 | Ciancio | 248/318 |
| 3,842,611 | 10/1974 | Anderson | 405/186 |
| 3,967,459 | 7/1976 | Denis | 405/186 |
| 4,220,110 | 9/1980 | Roberson | 114/315 |
| 4,310,110 | 1/1982 | Dexter | 224/246 |
| 4,382,318 | 5/1983 | Takimoto | 24/188 |
| 4,640,215 | 2/1987 | Purifoy, Jr. | 114/315 |
| 4,889,306 | 12/1989 | Boucher | 248/313 |
| 4,949,889 | 8/1990 | Carson | 224/270 |
| 5,022,649 | 6/1991 | Traub | 273/1.5 R |
| 5,161,722 | 11/1992 | Hembree | 224/262 |

FOREIGN PATENT DOCUMENTS

| | | | |
|---|---|---|---|
| 17196 | 1/1988 | Japan | 114/315 |
| 1341645 | 12/1973 | United Kingdom | 248/222.2 |

OTHER PUBLICATIONS

Advertisement: The Pony Tamer, Nov. 1, 1991.

Advertisement: The Pony Tamer, Mar. 1, 1992.

*Primary Examiner*—Edgar S. Burr

*Assistant Examiner*—Eric P. Raciti

*Attorney, Agent, or Firm*—Hedman, Gibson & Costigan

[57] ABSTRACT

A harness connector for securing a first tank to a second tank, for example for fastening an auxiliary air tank to a main air tank in scuba diving applications. The connector comprises a receiving member adapted to be secured to the first tank by a pair of tank clamps, and an attachment member adapted to be secured to the second tank by another pair of tank clamps. The receiving member and attachment member are formed so as to mate with one another, such as an attachment member with a T-shaped cross section mating with a receiving member with a U-shaped cross section. The harness connector further comprises locking means for selectively locking and unlocking the attachment member to and from the receiving member, such as a quick release type connector pin.

4 Claims, 7 Drawing Sheets

HARNESS CONNECTOR FOR SCUBA TANKS AND THE LIKE

FIELD OF THE INVENTION

The present invention relates generally to harness connectors for cylinders containing compressed gases such as tanks used in scuba diving, and in particular to sturdy quick release harness connectors which enable users to change tanks rapidly when desired.

BACKGROUND OF THE INVENTION

Cylinders containing compressed gases are used in various applications such as scuba diving, welding, fire fighting and chemical environments. Typically, the user mounts the cylinder, or tank, on a vest or frame which is worn like a backpack so that the cylinder is supported substantially by the user's shoulders and back. In addition to employing the strength of the user's shoulders and back to support the cylinder, this type of mounting affords the user maximum mobility and freedom of movement.

It is often required that the user have more than one tank available at any given time. For example, scuba divers entering overhead environments such as a shipwreck, cave, underground river or lake utilize multiple tank arrangements during dives. Divers also use multiple tanks, each containing different gasses to be utilized at different depths as required on deep dives. It is mandatory for any diver entering an overhead environment to use at least one auxiliary air tank in addition to the main tank. The auxiliary air tank is employed only as needed in the event of a failure with the main tank-/regulator system, thus providing the diver with air needed to return to the surface. In addition, scuba divers certified for technical diving often utilize additional tanks filled with several different gases, each for a different purpose. Oxygen enriched air (Nitrox) in various percentages is used at corresponding depths to limit the percentage of nitrogen taken into the body. Tri-mix and/or heliox is used on deep dives. Oxygen is used at the last decompression stop to aid in the off-gassing of the excess chemicals absorbed by the body during the dive.

The tank user often needs to change quickly the auxiliary tank and main tank arrangements. For example, while on the dive boat, scuba divers need to replace certain tanks depleted during the last dive in order to prepare for the next dive. The diver will need, therefore, to disengage the auxiliary tank or tanks from the main tank and reconfigure the tank assembly with different tanks as desired.

Apparatus in the prior art used to harness multiple tanks include that disclosed in U.S. Pat. No. 3,065,888 to Lande, which teaches the use of a single band for holding together two or three scuba tanks. Conventional nut and bolt assemblies are used to tighten the band around the tanks in order to secure them together. U.S. Pat. No. 3,191,828 to Senne discloses the use of a pair of bands, each band secured around a tank and held in place by use of an H-shaped yoke. The entire assembly is tightened together and to a supporting plate by nut and bolt type assemblies. These types of tank securing arrangements are not suited, however, for quickly changing tank arrangements. In addition to being unwieldy and time consuming, it is necessary to have available a set of associated tools. Moreover, these types of harness connections are often not sturdy enough to support the size and weight of certain tanks in use.

U.S. Pat. No. 4,949,889 to Carson discloses an apparatus for mounting an auxiliary air tank to a main tank, the apparatus comprising an L-shaped bracket for securing the auxiliary tank thereto. The bracket additionally comprises a mounting leg which forms an area for sliding over and grasping onto the strap which secures the main tank. The bracket and auxiliary tank are then secured by tightening the main tank strap around the mounting leg. Thus, the apparatus disclosed therein requires that the main tank strap be released, or at least loosened, in order to change auxiliary tanks. This arrangement is also disadvantageous since it relies upon the tension of the main tank strap, and appears unlikely to support large tanks.

It is therefore an object of the present invention to provide a tank harness connecting apparatus which overcomes the aforementioned disadvantages of the prior art.

Specifically, it is an object of the present invention to provide a tank harness connecting apparatus which is sturdy enough to secure together large tanks in a safe manner.

It is a further object of the present invention to provide a tank harness connecting apparatus which allows an additional auxiliary tank or tanks to be quickly disengaged from a depleted main tank and connected to another main tank for the next dive.

It is a further object of the present invention to provide a tank harness connecting apparatus which allows tanks to be changed without the need of tools.

SUMMARY OF THE INVENTION

In accordance with these and other objects, provided is a harness connector for securing a first tank to a second tank, the tanks being of the type utilized in scuba diving and the like, the harness connector comprising a receiving member adapted to be secured to the first tank, the receiving member being further adapted to receive a mating attachment member; an attachment member adapted to be secured to a second tank, the attachment member being further adapted to mate with the receiving member; and means for selectively locking and unlocking the attachment member to and from the receiving member.

The receiving member is of unitary construction and comprises a first side wall, a second side wall and a connecting wall, said walls formed in a substantially U-shaped cross sectional arrangement such that a substantially rectangular void exists between the first and second side walls. The receiving member further comprises a pin juxtaposed across the substantially rectangular void between the side walls, the pin disposed at the lower end of said receiving member. The first side wall has a first hole at the end opposite that of the pin, and the second side wall has a second hole at the opposite end of the pin, the first and second holes juxtaposed along a straight line. The receiving member additionally comprises a pair of holes positioned through the connecting wall so as to receive a pair of tank clamps by means of a T-bolt and trunion assembly. The tank clamps are then mounted onto a scuba tank or the like.

The attachment member is of unitary construction and comprises a mating portion adapted to fit into the substantially rectangular void of the receiving member and a back portion, such that the mating portion and back portion form a substantially T-shaped cross-sectional arrangement. The mating portion comprises a convex tab and semicircular notch disposed at a lower end thereof such that said notch fits snugly over and around the pin of the receiving member, and the mating portion of the attachment member can be inserted into the substantially rectangular void of the receiving member such that the resultant structure is substantially a rectangular box like shape. The mating portion further comprises a circular passage therethrough, which is located to be aligned with the first and second holes of the receiving member when the mating portion is fully interposed into the substantially rectangular void of the receiving member. The attachment member contains a pair of holes positioned through the back wall so as to receive a pair of tank clamps by means of a T-bolt and trunion assembly. The scuba tank clamps are then mounted onto a scuba tank or the like.

A pin utilizing a quick release locking feature is inserted through the aligned holes and locked therein. As a result, the attachment member is securely fastened to the receiving member, and the tank fastened to the tank clamps of the attachment member is effectively anchored to the tank fastened to the tank clamps of the receiving member. When it is desired to disassemble the tanks, the quick release pin is disengaged, and the tank-/attachment member assembly can be quickly and easily lifted from the tank/receiving member assembly. Different tanks which are loaded with similar attachment or receiving members can then be quickly mated as desired.

DESCRIPTION OF THE PREFERRED EMBODIMENT

Figure 1:
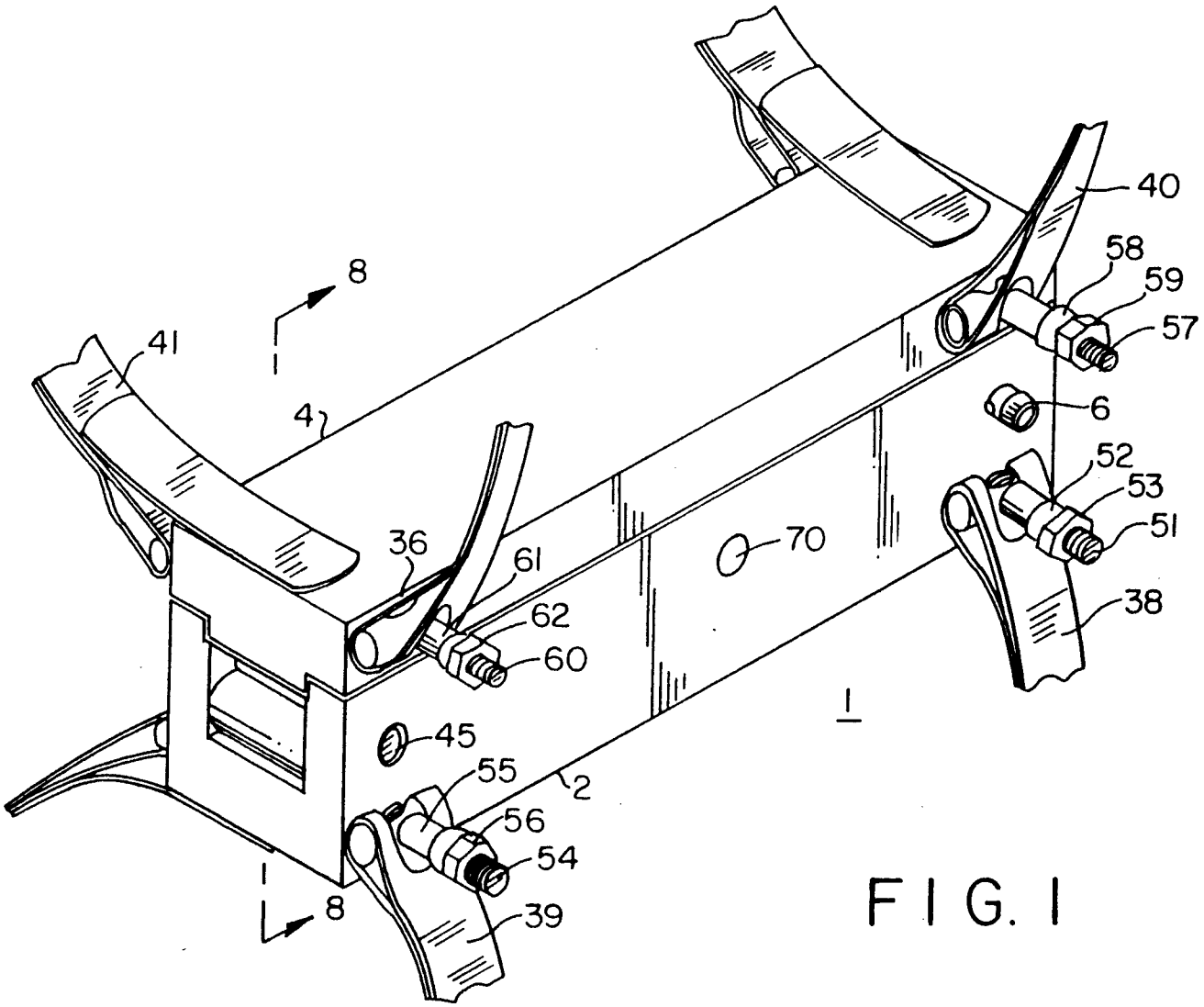
FIG. 1 is a perspective view of a preferred embodiment of the harness connector with tank clamps for tanks of the present invention.
Figure 2:
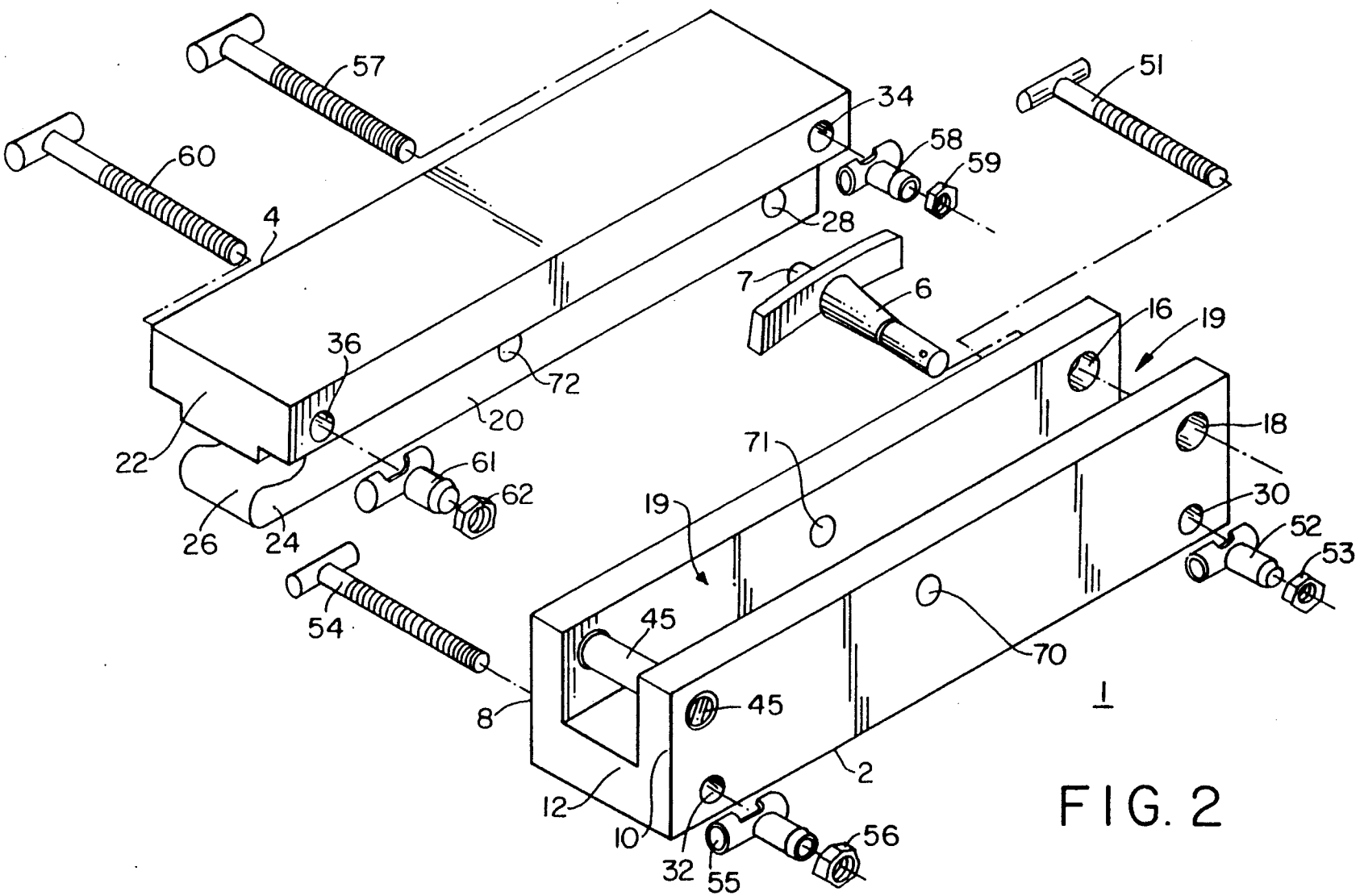
FIG. 2 is an exploded view of the harness connector of FIG. 1.

The preferred embodiment of the harness connector for scuba tanks will now be described in detail. Referring to FIGS. 1 and 2, the harness connector 1 comprises a receiving member 2, an attachment member 4, and a quick release pin 6. By depressing release tab 7 on the quick release pin 6, the quick release pin 6 can be withdrawn from the harness connector 1 so that the harness connector 1 can be separated into the receiving member 2 and the attachment member 4, as depicted in FIG. 2.

Figure 4B:
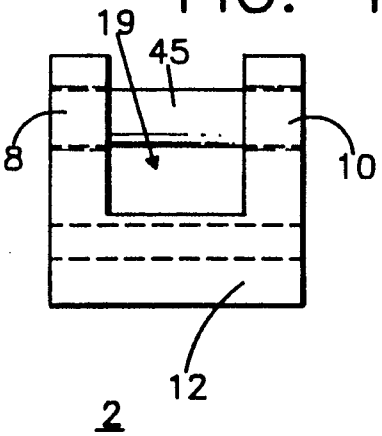
FIGS. 4A and 4B illustrate the receiving member of the harness connector of FIG. 1.
Figure 4A:
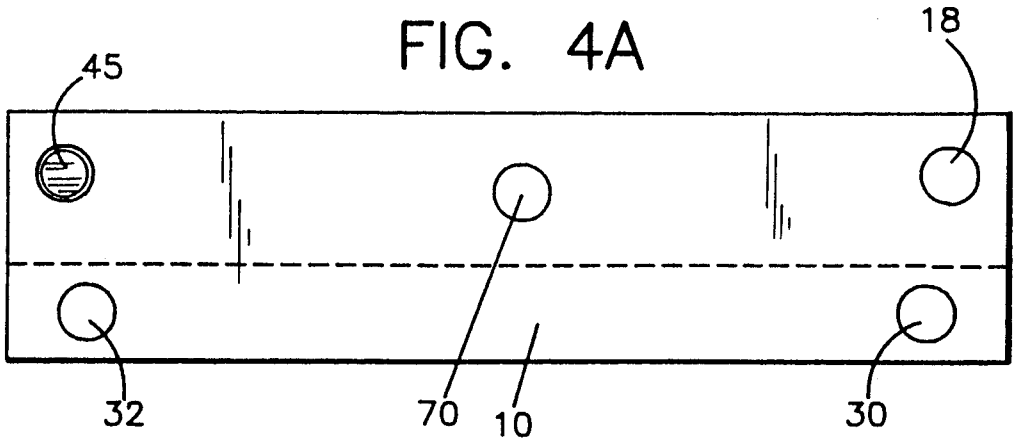

The receiving member 2, which is shown in detail in FIG. 4, is generally rectangularly box shaped and comprises a first side wall 8, a second side wall 10 and a connecting wall 12, which are formed in a U-shape cross sectional arrangement as shown. A substantially rectangular void 19 exists between the walls 8, 10 and 12.

As shown in FIG. 2, a pin 45 is secured near one end of the receiving member 2 and crosses through the rectangular void 19. The pin 45 is connected at a first end by the first side wall 8 and at a second end by the second side wall 10. At the opposite end of the receiving member 4, a first hole 16 is bored through the first side wall 8 and a second hole 18 is bored through the second side wall 10. The holes 16 and 18 are positioned in the same location on side walls 8 and 10, respectively, so that the quick release pin 6 can be inserted therethrough when the harness connector 1 is assembled.

The receiving member 2 also comprises a first T-bolt hole 30 and a second T-bolt hole 32, which are located near each end thereof and extend completely through the connecting wall 12. A first T-bolt 51 is inserted through a receiving portion at one end of a first tank clamp 38 and then through the receiving hole 30. A first trunion 52 is inserted through a receiving portion at the opposite end of the first tank clamp 38. The first trunion 52 is inserted on the first T-bolt 51, and a first nut 53 is threaded thereon to engage the T-bolt/trunion/clamp assembly with the receiving member 2. A second T-bolt 54, second trunion 55, second nut 56 and second tank clamp 39 are assembled in a similar fashion with the second T-bolt hole 32. When the tank clamps 38 and 39 are tightened around a scuba tank, the receiving member 2 is secured against the scuba tank and is ready for mating with the attachment member 4 and mounting on a scuba diver.

Figure 3B:
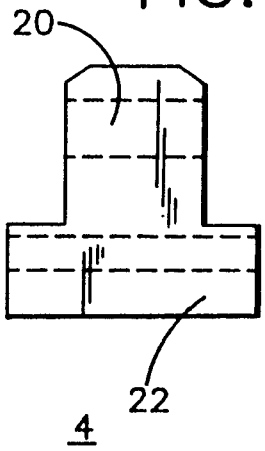
FIGS. 3A and 3B illustrate the attachment member of the harness connector of FIG. 1.
Figure 3A:
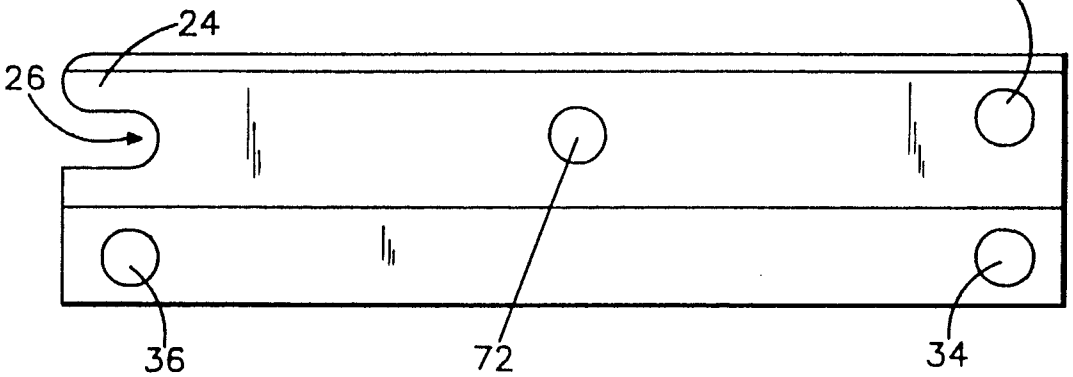

The attachment member 4, which is shown in detail in FIG. 3, is generally rectangularly box shaped and comprises a mating portion 20 and a back portion 22. The mating portion 20 and the back portion 22 are juxtaposed so as to form a T-shaped cross-sectional rectangular member, as shown in inverted form in FIG. 3B.

The mating portion 20 has a convex tab 24 and semicircular notch 26 formed at one end thereof. A circular passage 28 is bored through the opposite end of the mating portion. The convex tab 24 and the semicircular notch 26 are positioned such that they grasp the pin 45 when the mating portion 20 of the attachment member 4 is inserted into the rectangular void 19 of the receiving member 2. Likewise, the circular passage 28 is positioned on the mating portion 20 so it aligns with the holes 16 and 18 of the receiving member 2.

When the attachment member 4 is joined with the receiving member 2 in this manner, the convex tab 24, the semicircular notch 26, and the pin 45 operate as a hinge such that the attachment member 4 can rest upon and swing around the pin 45 of the receiving member 2, when in a vertical position.

The attachment member 4 is locked into place by inserting the quick release pin 6 into the shaft formed by the mating of the holes 16 and 18 and the circular passage 28. The quick release pin of the preferred embodiment has a release tab 7, which must be depressed in order for the quick release pin 6 to be removed. Thus, the harness connector 1 will remain assembled together in this manner until it is desired to change tanks; at that time, the release tab 7 can be depressed.

The attachment member 4 also comprises a third T-bolt hole 34 and a fourth T-bolt hole 36, which are located near each end thereof and extend completely through the back portion 22. A third T-bolt 57, third trunion 58, third nut 59 and third tank clamp 40 are assembled with the third T-bolt hole 34 as previously described, and a fourth T-bolt 60, fourth trunion 61, fourth nut 62 and fourth tank clamp 41 are assembled with the fourth T-bolt hole 36 as previously described. When the tank clamps 40 and 41 are tightened around a scuba tank, the attachment member 4 is secured against the scuba tank and is ready for mating with the receiving member 2 and mounting on a scuba diver.

Figure 7:
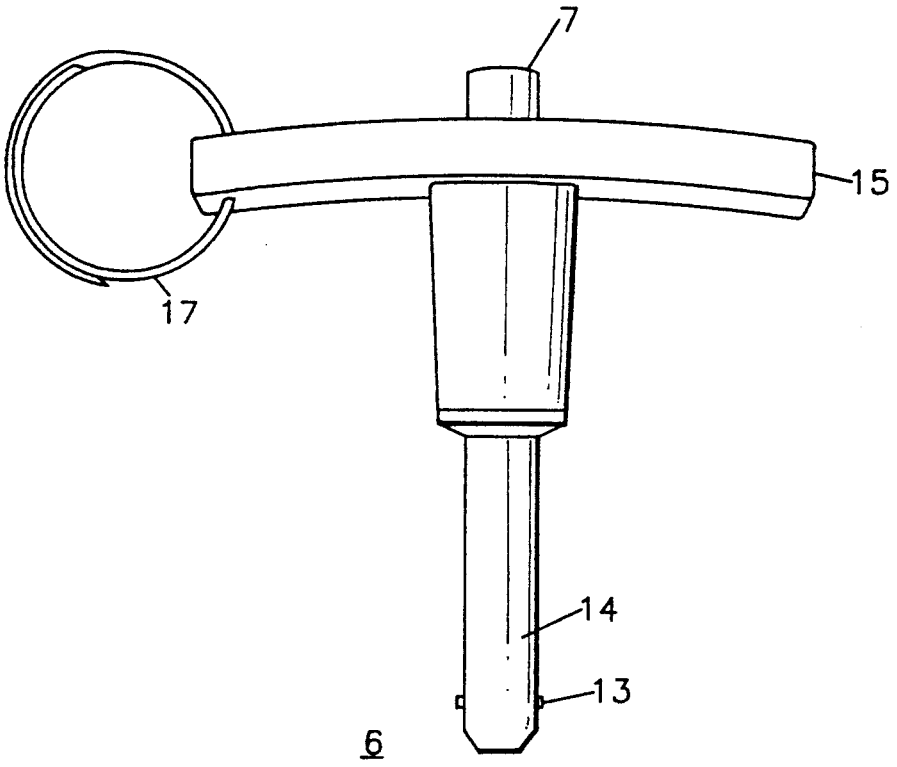
FIG. 7 illustrates the quick release pin of the harness connector of FIG. 1.
Figure 8:
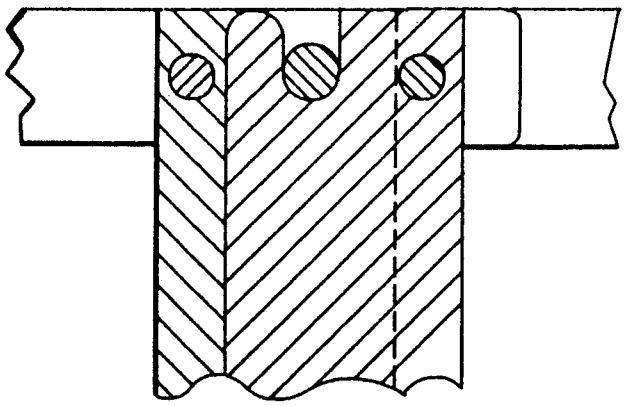
FIG. 8 is a sectional view taken along line 8—8 of FIG. 1.

The quick release pin 6 of the preferred embodiment is shown in FIG. 7. The quick release pin 6 comprises the release tab 7, a handle 15, a shaft 14 connected axially thereto, and a pair of locking portions 13 extending perpendicularly from the shaft 14. When the handle 15 is grasped and the release tab 7 is depressed, the locking portions 13 are drawn into the shaft 14, thus allowing the shaft 14 of the pin 6 to be inserted into the harness connector 1. When the release tab 7 is released, the locking portions 13 return to their quiescent protruding state, thus locking the pin 6 in place by preventing the shaft 14 from being drawn out of the harness connector 1. When it is desired to disengage the attachment member 4 from the receiving member 2, the release tab 7 is depressed, thereby drawing the locking portions 13 into the shaft 14, and the pin 6 can be removed.

Figure 5:
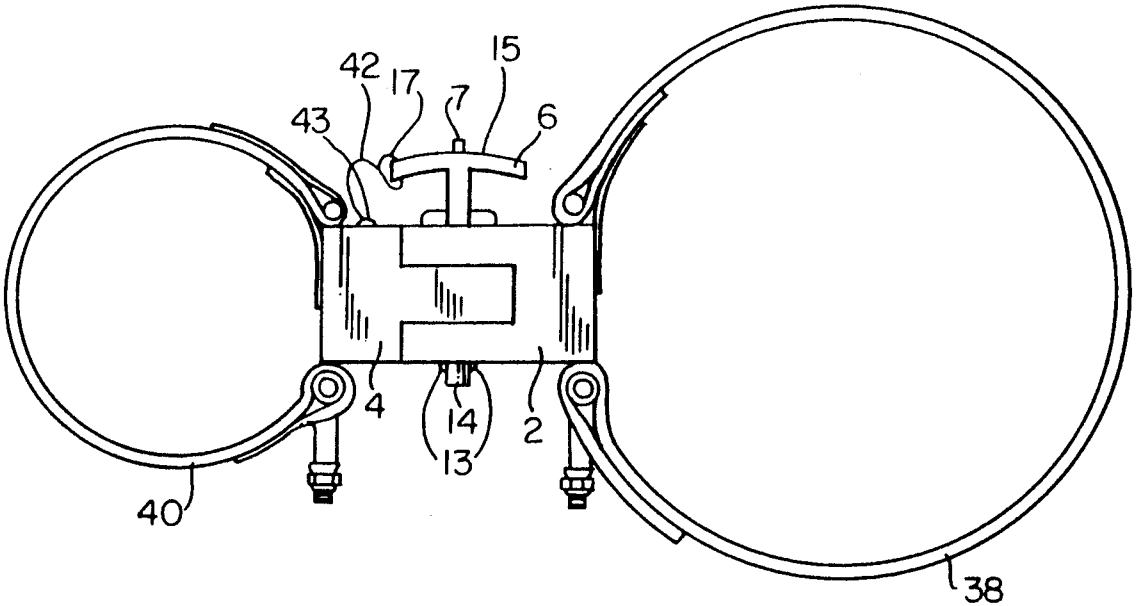
FIG. 5 is a top plan view of the harness connector of FIG. 1.

As shown in FIG. 5, the quick release pin 6 can be attached to the attachment member 4 or the receiving member 2 via cable 42 (or a chain), ring 17, and tie down screw 43. By implementing the quick release and locking features described herein, the preferred embodiment of the present invention eliminates the need for special tools to be available when changing tanks.

Although the preferred embodiment of the present invention utilizes the quick release pin 6 described herein, it is contemplated that any similar type mechanism which provides a sturdy connection and quick release features can be likewise employed.

The harness connector 1 of the preferred embodiment is fabricated from stainless steel known as 316L marine stainless steel. This provides the harness connector 1 with the sturdiness required in order to be utilized with tanks of compressed gas, which may weigh in the range of 15 to 90 pounds each.

Figure 6:
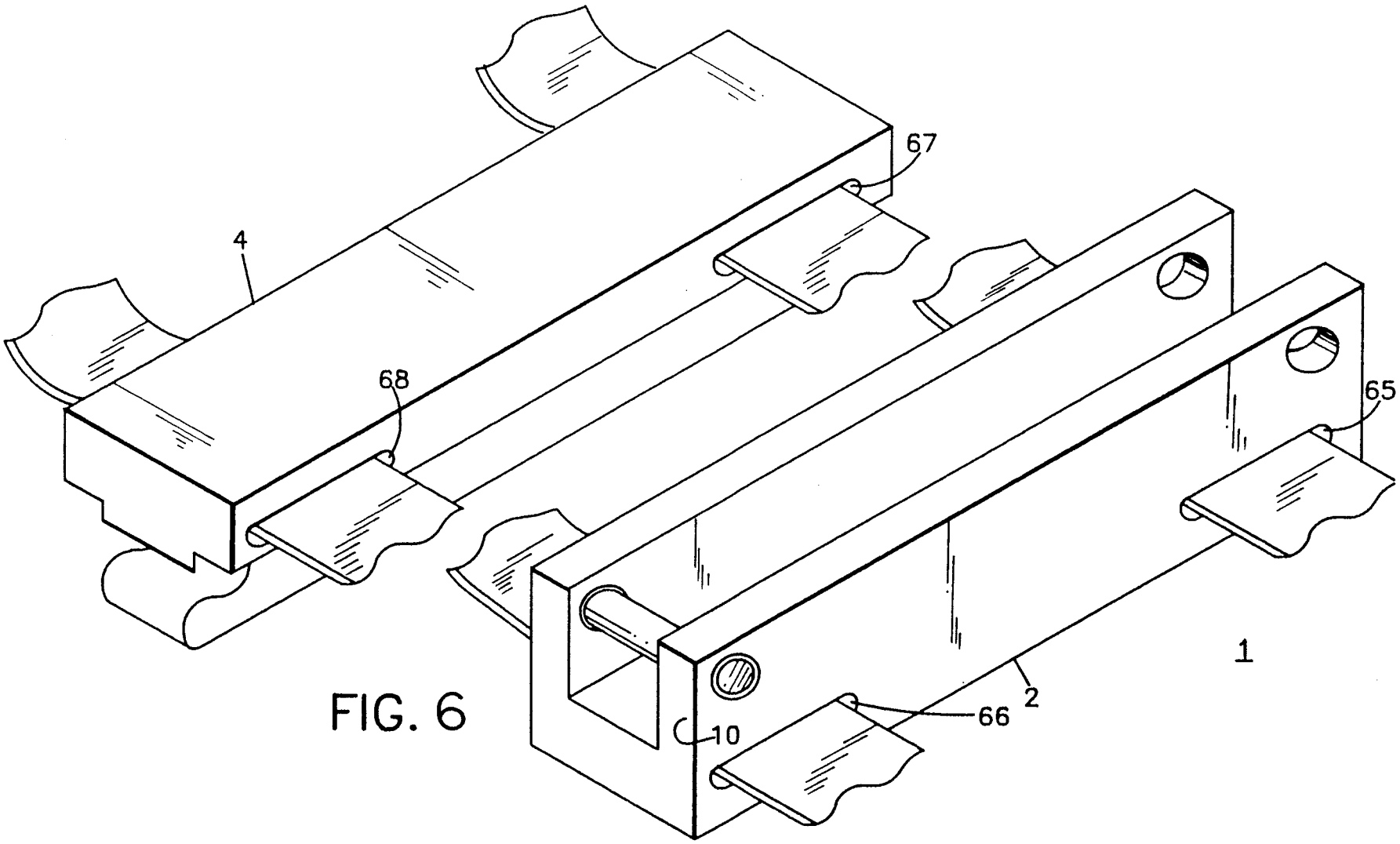
FIG. 6 is a perspective view of an alternative embodiment of the harness connector of the present invention.

FIG. 6 depicts an alternative embodiment which does not utilize the T-bolt/trunion/nut assembly of the preferred embodiment. The tank clamps are inserted through slots 65, 66, 67 and 68 for securing to the tanks as desired.

The present invention can also be used to connect a main tank to a backpack directly. Holes 70, 71 and 72 align to form a contiguous chamber when the receiving member 2 and the attachment member 4 are interlocked as previously described. A bolt can then be inserted through the chamber and onto the backpack for a secure and sturdy attachment.

It is contemplated that a plurality of harness connectors of the preferred embodiment can be utilized to secure the desired number of tanks for a particular application. Practice has taught that up to seven tanks may be required, for example, in deep sea or cave diving. By daisy chaining the appropriate attachment and receiving members, it is possible to quickly interchange any combination of tanks as desired.

I claim:

1. A harness connector for securing a first tank to a second tank, the tanks being of the type utilized in scuba diving and the like, the harness connector comprising:

(a) a receiving member adapted to be secured to the first tank, the receiving member being further adapted to receive a mating attachment member, the receiving member comprising means for releasably securing a pair of tank clamps;

(b) an attachment member adapted to be secured to a second tank, the attachment member being further adapted to mate with the receiving member, the attachment member comprising means for releasably securing a pair of tank clamps; and (c) means for selectively locking and unlocking the attachment member to and from the receiving member;

wherein the receiving member comprises a pin and the attachment member comprises a semicircular notch adapted to engage said pin;

whereby upon engagement of the notch onto the pin, the attachment member can swing about the pin from an unmated position to a mated position.

2. The harness connector of claim 1 wherein the locking means comprise a quick release type connector pin.

3. A harness connector for securing a first tank to a second tank, the tanks being of the type utilized in scuba diving and the like, the harness connector comprising:

(a) a receiving member comprising (i) a first side wall, a second side wall, and a connecting wall, the walls formed of unitary construction in a substantially U-shaped cross sectional arrangement such that a substantially rectangular void exists between the first side wall, the second side wall and the connecting wall, (ii) a pin connected between the side walls and across the substantially rectangular void, the pin disposed at a lower end of the receiving member, (iii) a pair of holes positioned through the connecting wall so as to receive a pair of tanks clamps using a T-bolt and trunion, and (iv) the receiving member further having a first hole in the first side wall at the end opposite that of the pin and a second hole in the second side wall at the end opposite that of the pin, the first and second holes juxtaposed to form a straight line perpendicular to the side walls;

(b) an attachment member of unitary construction comprising (i) a back portion, (ii) a mating portion adapted to fit into the substantially rectangular void of the receiving member, the mating portion and the back portion forming a substantially T-shaped cross sectional arrangement, the mating portion further comprising a convex tab and a semicircular notch disposed at a lower end thereof such that the notch fits snugly over and around the pin of the receiving ember, a circular passage disposed through the mating portion and located to be aligned with the first and second holes of the receiving member when the mating portion is fully interposed into the substantially rectangular void of the receiving member, and (iii) a pair of holes positioned through the back portion so as to receive a pair of tank clamps using a T-bolt and trunion; and (c) means for securing the attachment member to the receiving member, said means comprising a quick release connector pin adapted to fit through the first and second holes of the receiving member and the circular passage of the mating portion of the attachment member when the mating portion is fully interposed into the substantially rectangular void of the receiving member;

4. A harness connector as in claim 3 further comprising at T-bolt, trunion and tank clamp associated with each of said holes in said back portion of said attachment member and with each of said holes in said connecting wall of said receiving member.

* * * * *